United States Patent [19]

Honda et al.

[11] Patent Number: 4,750,128

[45] Date of Patent: Jun. 7, 1988

[54] AIR/FUEL RATIO CONTROL FOR AN INTERNAL COMBUSTION ENGINE WITH IMPROVED FAIL-SAFE DEVICE

[75] Inventors: Masakazu Honda, Anjo; Akio Kobayashi, Kariya; Susumu Harada, Okazaki; Takehiro Kikuti, Oobu, all of Japan

[73] Assignee: Nippondenso Co., Ltd., Kariya, Japan

[21] Appl. No.: 827,499

[22] Filed: Feb. 7, 1986

Related U.S. Application Data

[63] Continuation of Ser. No. 530,672, Sep. 9, 1983, abandoned.

[30] Foreign Application Priority Data

Sep. 11, 1982 [JP] Japan ..... 57-158575

[51] Int. Cl.[4] ..... F02D 37/02

[52] U.S. Cl. ..... 364/431.11; 123/479; 371/9

[58] Field of Search ..... 364/431.11, 431.05; 123/479, 480; 371/9

[56] References Cited

U.S. PATENT DOCUMENTS

| | | | |
|---|---|---|---|
| 3,834,361 | 9/1974 | Keely | 123/479 |
| 4,261,314 | 4/1981 | Graessley | 123/480 |
| 4,365,299 | 12/1982 | Kondo et al. . | |
| 4,370,962 | 2/1983 | Hosaka . | |
| 4,408,584 | 10/1983 | Yabuhara et al. | 123/479 |
| 4,414,949 | 11/1983 | Honig et al. | 123/479 |
| 4,440,136 | 4/1984 | Denz et al. | 123/480 |
| 4,444,048 | 4/1984 | Nitschke et al. | 371/9 |
| 4,483,301 | 11/1984 | Yamada et al. | 123/480 |

FOREIGN PATENT DOCUMENTS

| | | | |
|---|---|---|---|
| 0058110 | 5/1979 | Japan | 123/479 |
| 0148925 | 11/1980 | Japan | 123/479 |
| 56-135201 | 10/1981 | Japan . | |
| 0013237 | 1/1982 | Japan | 123/479 |

*Primary Examiner*—Parshotam S. Lall

*Attorney, Agent, or Firm*—Cushman, Darby & Cushman

[57] ABSTRACT

In a computer-controlled fuel supply system of an internal combustion engine, two basic pieces of information, i.e. airflow data Q and engine speed data N, are processed by an analog operating circuit to produce a basic injection pulse signal, whose pulse width equals Q/N. The data Q/N is used by a microcomputer, when the microcomputer is in normal state, to produce a corrected injection pulse signal by using various engine parameters in the same manner as in conventional arrangements, and fuel flow is determined by the width of the corrected injection pulse signal. When malfunctioning of the microcomputer is detected, the basic injection pulse signal from the analog operating circuit is used in place of the corrected injection pulse signal from the microcomputer to determine the fuel flow. The width of the basic injection pulse signal may be lengthened when the microcomputer is in abnormal state so that air/fuel ratio is almost accurately controlled without the microcomputer.

3 Claims, 5 Drawing Sheets

AIR/FUEL RATIO CONTROL FOR AN INTERNAL COMBUSTION ENGINE WITH IMPROVED FAIL-SAFE DEVICE

This is a continuation of application Ser. No. 530,672, filed Sept. 9, 1983, which was abandoned upon the filing hereof.

BACKGROUND OF THE INVENTION

This invention generally relates to air/fuel ratio control for an internal combustion engine of vehicles, and more particularly, the present invention relates to such an air/fuel ratio control with a fail-safe device capable of causing the engine to operate during failure of computer control.

Microcomputers are widely used for air/fuel ratio control of an internal combustion engine of motor vehicles or the like. Although the ratio of the air/fuel mixture supplied to an internal combustion engine is optimally controlled on the basis of necessary control information by a microcomputer in conventional computer-controlled engines, once the microcomputer malfunctions fuel supply is interrupted or becomes uncontrollable. In motor vehicles, such undesirable state should be avoided to ensure the safety of passengers. Therefore, some conventional air/fuel ratio control apparatus having a microcomputer is equipped with a fail-safe device as disclosed in Japanese Patent Provisional Publication No. 56-135201 and its corresponding U.S. Pat. No. 4,370,962. According to this prior art a fail-safe device, which operates independently of the microcomputer, is additionally provided so that fuel supply to the engine is continuously ensured even after the microcomputer starts malfunctioning, allowing the engine to continuously operate. As a result, the motor vehicle can be driven, and therefore, it is possible to prevent the motor vehicle from undesirably stopping on a road so that it can be driven it to a nearest service station.

However, in such conventional air/fuel control apparatus, fuel flow is fixed when the fail-safe device operates because fuel injector driving pulses are produced in response to only an engine rotational signal. Namely, the injector driving pulse width is kept constant of the airflow. As a result, although it is possible to drive the motor vehicle at low speeds, such as under 50 Km/h, higher speed driving cannot be expected, while it suffers from unsatisfactory drivability. Furthermore, since the ratio is not positively controlled, the engine is apt to suffer from undesirable combustion, such as misfiring, emission of noxious gasses or the like.

Moreover, since the conventional microcomputer used to determine air/fuel ratio is arranged such that all necessary calculation instructions are programmed in its memory, instructions for deriving a value Q/N by digitally dividing the airflow data Q by the engine speed data N are also prestored in the memory. As a result, a memory having a relatively large storing capacity is required, while a relatively high programming cost is also required.

SUMMARY OF THE INVENTION

The present invention has been developed in order to remove the above-described drawbacks inherent to the conventional air/fuel ratio control apparatus employed for vehicles.

It is, therefore, an object of the present invention to provide a new and useful air/fuel ratio control apparatus having a microcomputer and a fail-safe device which is capable of supplying the engine with fuel in a desired manner even if the microcomputer operates abnormally.

According to a feature of the present invention an analog operating circuits is provided to process an intake airflow signal and an engine speed signal to produce a basic injection pulse signal so that the basic injection pulse signal is used by the microcomputer to precisely control the air/fuel ratio in view of various engine operating parameters as long as the microcomputer is in a normal state, and is also directly used to control fuel flow in the case that the microcomputer malfunctions.

According to another feature of the present invention the pulse width of the basic injection pulse signal may be lengthened by multiplying a constant value in the case that the microcomputer malfunctions, so that air/fuel ratio is almost accurately controlled.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Prior to describing an embodiment of the present invention, the above-mentioned conventional air/fuel ratio control apparatus having a fail-safe device will be described for a better understanding of the present invention.

Figure 1:
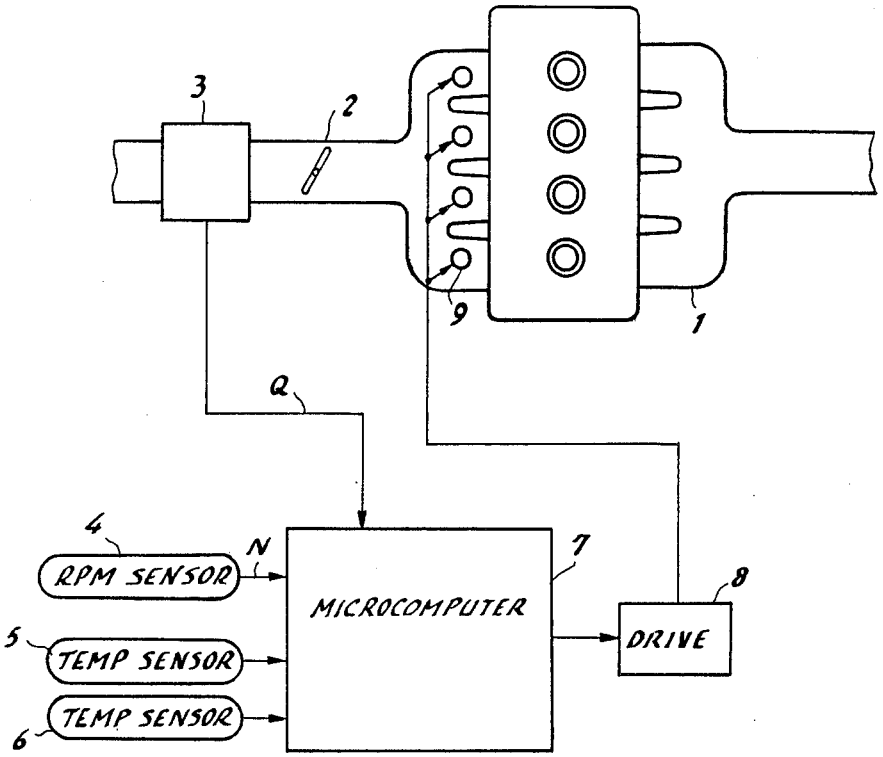
FIG. 1 is a diagram showing an air/fuel ratio control system having a computer to which the present invention is applicable.

FIG. 1 shows an example of a computer-controlled engine system to which the present invention is applicable. The system comprises an internal combustion engine 1, used as a prime mover of an unshown motor vehicle. The engine 1 is of the type arranged to be supplied with fuel via fuel injectors 9 provided to respective cylinders. The air/fuel ratio of the mixture supplied to engine cylinders is determined by the opening duration of the respective fuel injectors 9. To this end the fuel injectors 9 are controlled by fuel injection pulses fed from an injector-driving circuit 8 which is responsive to an output signal from a control--unit actualized by a microcomputer 7 which functions as a fuel-injecting time determining circuit. The microcomputer 7 is basically responsive to intake airflow data from an intake airflow sensor 3, such as an airflow meter, and to engine rotational speed data from an engine rpm sensor 4. The fuel injecting time or valve-opening duration is basically determined by using the intake airflow data and engine speed data, and this injecting time is further corrected by using additional engine operating condition data, such as engine coolant temperature data from a temperature sensor 5 and intake air temperature data from another temperature sensor 6. Furthermore, some additional information may be inputted to the microcomputer 7 for further accurate determination of the fuel injecting time, and therefore the fuel flow. The above-described coventional computer-controlled air/fuel ratio determining system is well known in the art. For instance such a system is disclosed in U.S. Pat. No. 4,365,299.

In order to ensure safe drive of the motor vehicle whose engine is controlled by a computer, at least minimum fuel flow necessary for engine operation has to be maintained so that the driver of the motor vehicle can drive the vehicle even if the computer malfunctions. Although the fail-safe device disclosed in the above-mentioned Japanese prior art reference 56-135201 is capable of continously supplying fuel to the engine on malfunction of the computer, desired air/fuel ratio control and drivability cannot be expected.

Figure 2:
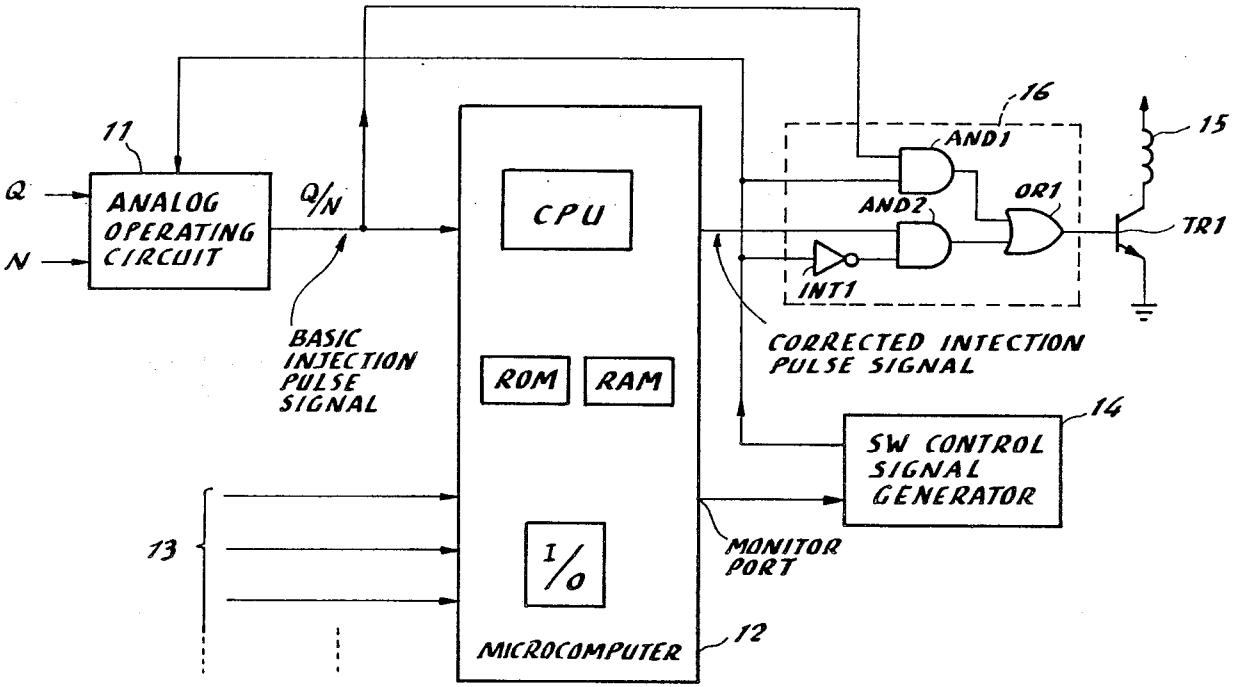
FIG. 2 is a schematic block diagram of an embodiment of the apparatus according to the present invention.

FIG. 2 shows a schematic diagram of an embodiment of the present invention. The air/fuel ratio control apparatus of the embodiment generally comprises a microcomputer 12, an analog operating circuit 11, a switching signal generating circuit 14, and a selecting circuit 16. The microcomputer 12 comprises a central processing unit (CPU), a read-only memory (ROM), a random-access memory (RAM), and an input-output (I/O) device in the same manner as in conventional microcomputers. Although the microcomputer 12 determines the fuel injecting time, i.e. opening duration of fuel injectors, by using intake airflow data Q and engine speed data N and also some engine operating condition data from various sensors 13 in the same manner as in conventional systems, the intake airflow data Q and engine speed data N are fed via the analog operating circuit 11 to the microcomputer 12. Namely, the analog operating circuit 11 is an analog divider as will be described later with reference to FIG. 3, so that it outputs data indicative of Q/N in the form of a pulse signal.

The pulse width of the pulse signal is indicative of Q/N, and the pulse signal from the analog operating circuit 11 is referred to as a basic injection pulse signal. The microcomputer 12 uses this data Q/N from the analog operating circuit 11, and the basic injecting time represented by the width of the basic injection pulse signal is further corrected by using engine operating condition data in the same manner as in conventional air/fuel control apparatus. In this way an output signal is derived from an output terminal of the microcomputer 12 to be applied via the selecting circuit 16 to a switching transistor TR1 which energizes an injection valve solenoid 15. Although FIG. 2 shows only a single switching transistor and an injection valve solenoid for simplicity, a plurality of these devices are actually provided to supply fuel to respective cylinders.

It is to be noted that since the microcomputer 12 receives the data Q/N from the analog operating circuit 11, there is no need to digitally dividing airflow data Q by engine speed data N as in conventional microcomputers used for air/fuel ratio control. As a result, operating program stored in the ROM can be simplified, while a memory having a relatively small storing capacity may be used as the ROM.

Figure 3:
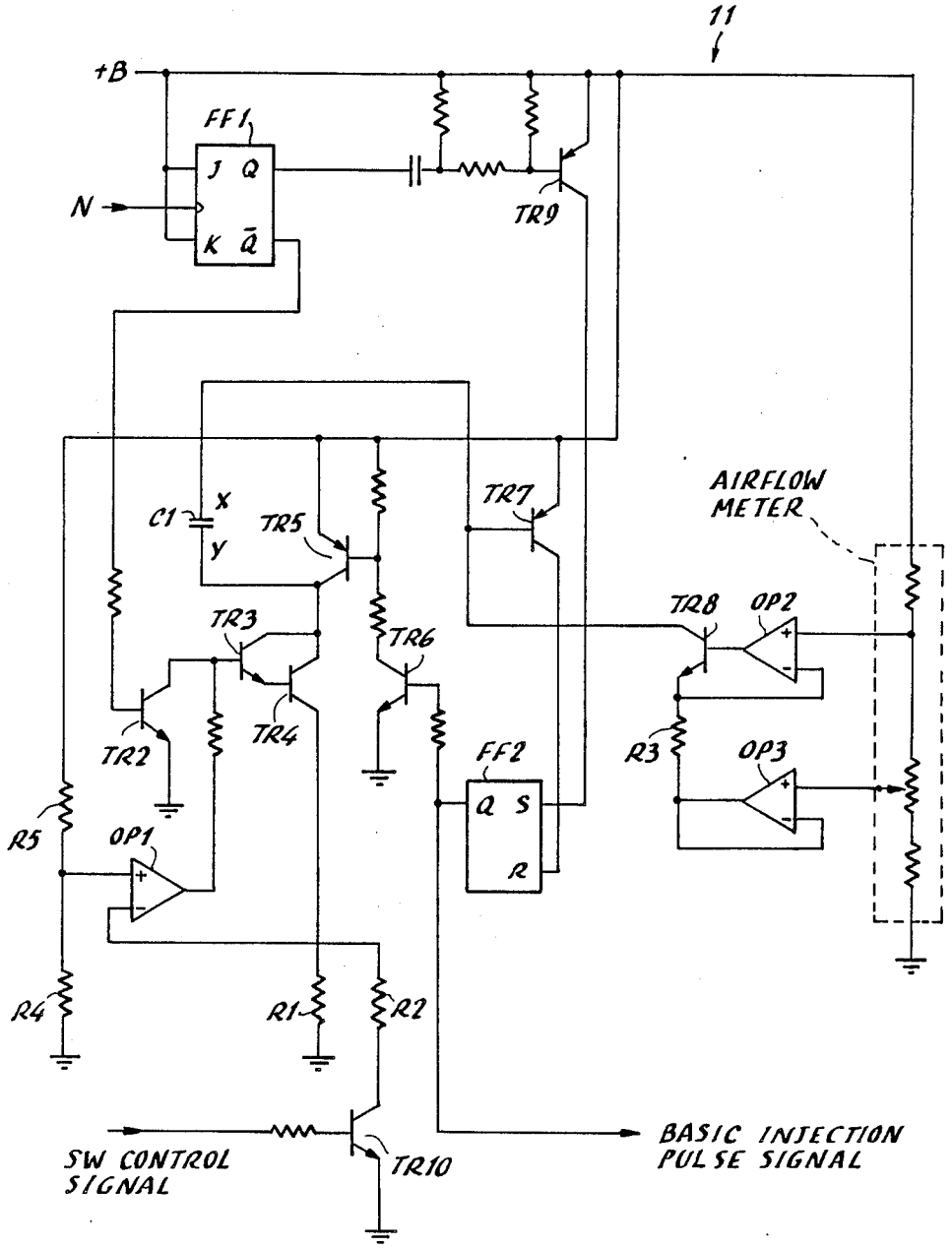
FIG. 3 is a circuit diagram of the analog operating circuit of FIG. 2.
Figure 4:
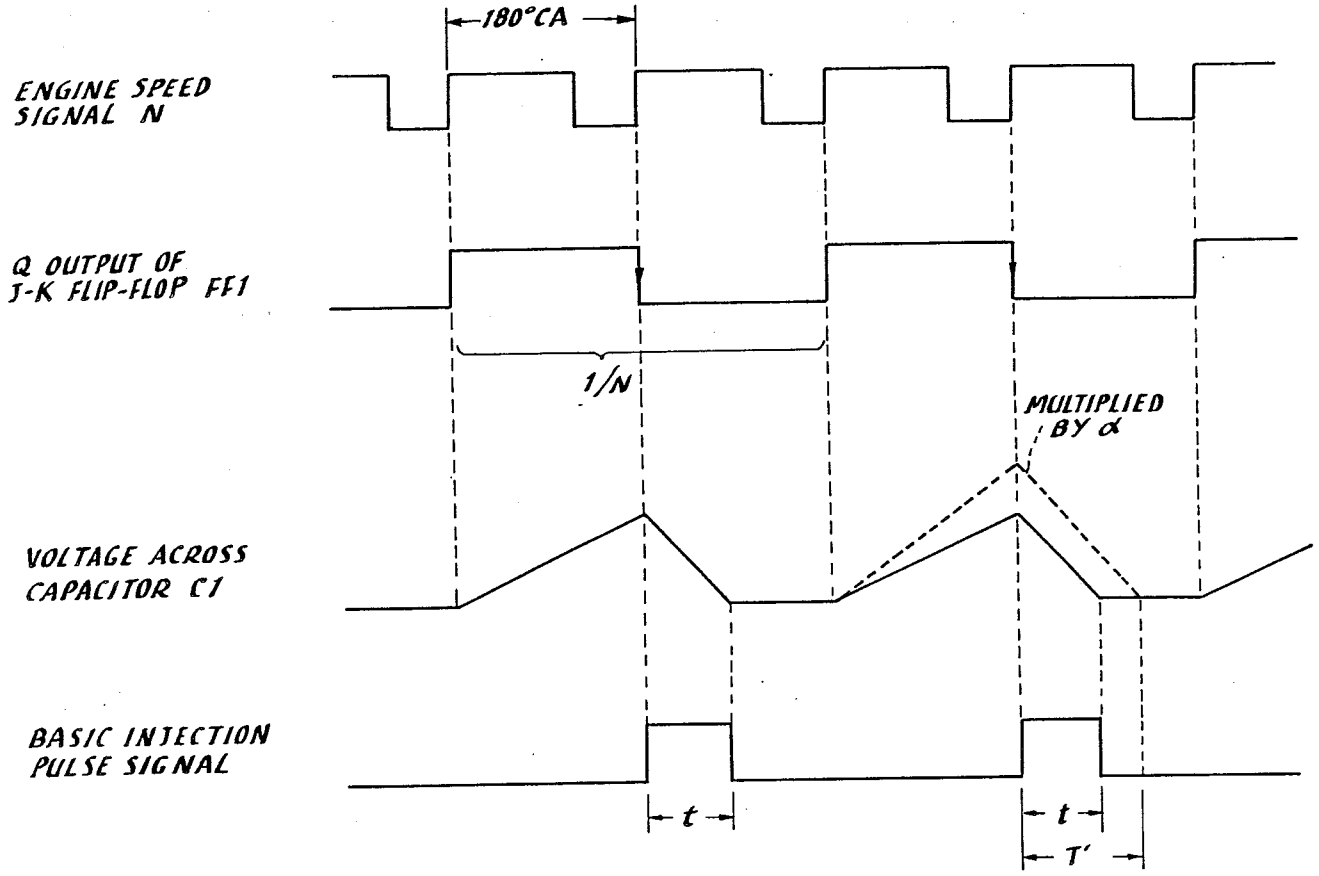
FIG. 4 is a time chart useful for understanding the operation of the analog operating circuit.

Reference is now made to FIG. 3 showing a circuit diagram of the analog operating circuit 11 of FIG. 2. The analog operating circuit 11 receives two input signals, one being intake airflow signal Q and the other being engine speed signal N. The intake airflow signal Q is an analog signal which is derived from an airflow meter having a potentiometer whose movable contact moves in accordance with the airflow through the intake passage of the engine. The engine speed signal N is a pulse train signal derived from a crank angle sensor or the like.

The analog operating circuit 11 is also responsive to a computer-state signal, which is referred to as a switching control signal because it also controls the selecting circuit 16, fed from the switching control signal generator 14 so that an output signal of the analog operating circuit 11 changes in accordance with the state of the microcomputer 12, such that the pulse width of the basic injection pulse signal is multiplied by a constant.

The operation of the analog operating circuit 11 will be described with reference to a time chart of FIG. 5. A J-K flip-flop FF1 is responsive to the engine speed signal N from a crank angle sensor, at its clock input, and therefore, the frequency of the engine speed signal N is divided by two. Namely, two frequency-divided signals of opposite polarity are respectively obtained at output terminals Q and $\overline{Q}$ of the flip-flop FF1. The output $\overline{Q}$ is connected via a resistor to a base of a transistor TR2, and therefore, the transistor TR2 is kept nonconductive when output $\overline{Q}$ is of low level, i.e. high level period at output Q. A capacitor C1 is connected between a transistor TR7 and a constant-current circuit comprising transistors TR3 and TR4 and an operational amplifier OP1. This capacitor Cl is charged by a charging current which flows via the emitter-base path of the transistor TR7 and a resistor R1. when the transistor TR2 turns off, where the amount of the charging current is determined by the value of the resistor R1. Therefore, a voltage across the capacitor C1 linearly increases as shown in FIG. 5. In the presence of a trailing edge of the pulse at Q output of the flip-flop FF1, charging of the capacitor C1 terminates. Simultaneously, an RS flip-flop FF2 is triggered at its S input so that the signal level of its Q output turns high. An output signal from the Q output of the flip-flop FF2 is used as the above-mentioned basic injection pulse signal, and is also fed via a resistor to a transistor TR6 to turn on the same as well as another transistor TR5. As a result, one terminal Y of the capacitor C1 is connected to positive power source line +B via the transistor TR5. Thus, the capacitor C1 is discharged via a transistor TR8 with a constant discharging current determined by the voltage from the airflow meter and the value of a resistor R3 so that the voltage at the terminal Y equals the voltage of the power source line +B.

When the voltage at another terminal X of the capacitor C1 lowers below the power source voltage, the transistor TR7 turns on to reset the flip-flop FF2 causing Q output of the flip-flop FF2 to assume low level. Summarizing the operation of the analog operating circuit 11 of FIG. 3, the frequency-divided signal obtained by the J-K flip-flop FF1 gives a duration equal to 1/N, wherein N is engine speed, and the capacitor C1 is charged with a constant charging current only when Q output of the flip-flop FF1 assumes high level. As a result, the voltage acorss the capacitor C1 increases until the presence of the trailing edge of the positive-going pulse at the Q output of the flip-flop FF1. After the instant of the trailing edge, the capacitor C1 starts discharging with a constant discharging current determined by the intake airflow. When discharging is completed, the flip-flop FF2 is reset, and therefore the level of the injection pulse signal becomes low.

The operation has been described under an assumption that the switching control signal indicative of the state of the microcomputer 12 is of low level. Namely, when the microcomputer 12 normally operates, the analog operating circuit 11 functions as described in the above. On the other hand, when the switching control signal turns high as will be described later with the detection of malfunction of the microcomputer 12, a transistor TR10 is rendered conductive allowing the charging current to flow not only the resistor R1 but also another resistor R2. In other words, the amount of the charging current is determined by a combined resistance determined by the parallel connection of the resistors R1 and R2. Thus, the amount of charging current is now greater than before. This increase in charging current results in higher voltage across the capacitor C1 as shown by a dotted line indicating the capacitor voltage in FIG. 5, and therefore it results in increase in the basic injection duration. In other words, the fuel injection duration or injection pulse width is multiplied by a factor $\alpha$ wherein $\alpha > 1$ to be lengthened. Although the injection pulse width is multiplied by a by changing the charging current in the above-described embodiment, the basic injection duration may be multiplied by $\alpha$ by changing the discharging current. To this end the value of the resistor R3 may be changed in response to the switching control signal. Furthermore, a reference voltage determined by two resistors R4 and R5 and applied to the operational amplifier OP1 may be changed by varying the voltage dividing ratio to change the charging current.

From the above it will be understood that the analog operating circuit 11 processes the airflow signal Q and the engine speed signal N to provide an output basic injection pulse signal Q/N where the width of the basic injection pulse signal is changed in accordance with the normal/abnormal state of the microcomputer 12. The basic injection pulse signal Q/N is used by the microcomputer 12, when the microcomputer 12 is in normal state, to produce an injection pulse signal fed to the transistor TR1. The basic injection pulse signal is processed so that its pulse width is modified such that it is multiplied by one or more correction factors which may be derived from various engine operational parameters in the same manner as in a conventional computer-controlled engine system disclosed in the aforementioned U.S. Pat. No. 4,365,299. On the contrary, when the microcomputer 12 malfunctions, the basic injection pulse signal, which has been multiplied by as described in the above, is fed via the selecting circuit 16 to the transistor TR1. This multiplication by a is effected to correct the pulse width of the basic inejction pulse signal so that the pulse width defining the fuel flow does not greatly deviate from that which would have been obtained by the microcomputer 12. Namely, the value of is selected to an average value of the product ($K1 \times K2 \times K3 \times \ldots$) of the correction factors K1, K2, K3 . . . used to correct the pulse width t of the basic injection pulse signal for obtaining corrected injection pulse width T in accordance with the following equation.

$$T = t \times K1 \times K2 \times K3 \times \ldots$$

Although the correction factors K1, K2, K3 . . . are variable, an average value of the product thereof is usually around a given value such as 1.2, and therefore, the above-mentioned value $\alpha$ may be set to this given value. Since the width t of the basic injection pulse is multipled by $\alpha$ when the microcomputer 12 malfunctions, the resultant pulse width T' is approximately equal to the above-mentioned corrected pulse width T. With this operation therefore, almost accurate air/fuel ratio control can be attained even if the microcomputer 12 is in abnormal state.

Figure 5A:
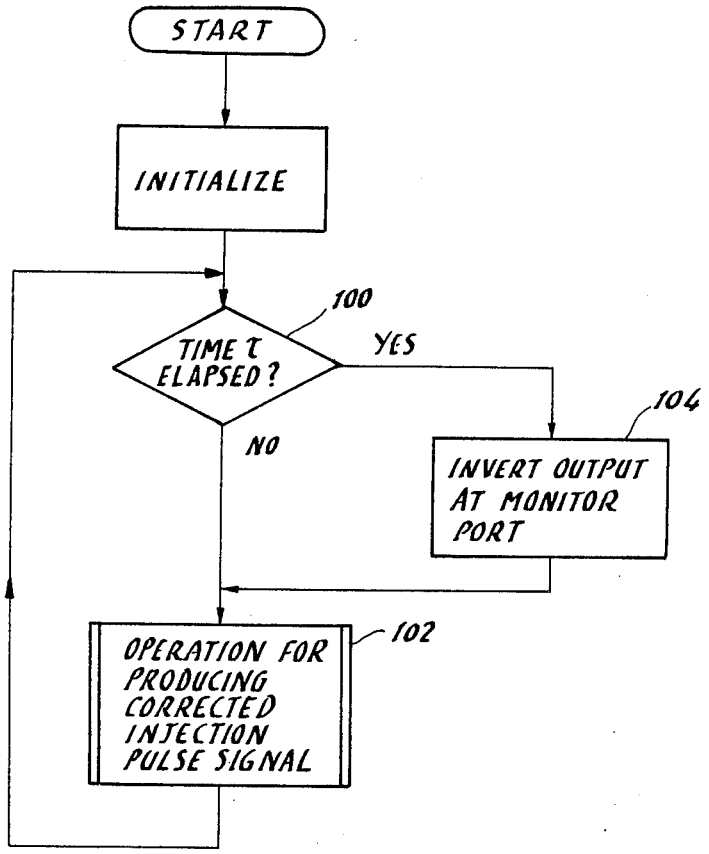
FIG. 5A is a flowchart showing the operating program of the microcomputer used in the embodiment of FIG. 2.
Figure 5B:
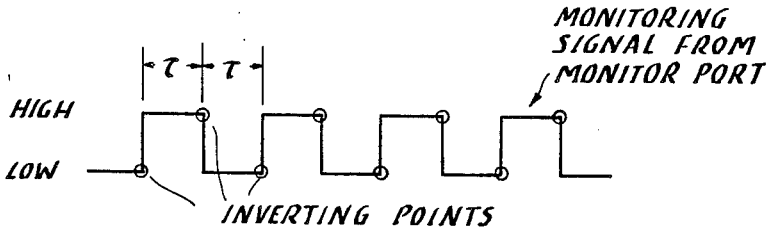
FIG. 5B is a waveform chart showing the monitoring signal derived from the microcomputer.

Now the way of detecting the malfunction or abnormal state of the microcomputer 12 will be described. FIG. 5A shows a schematic flowchart of the operation of the CPU of the micromputer 12. The flowchart shows a set of operating steps by a single step 102 for simplicity because the operating steps necessary for processing the basic injection pulse signal Q/N is known in the art. Namely, the microcomputer 12 determines the width of the injection pulse fed to the transistor TR1 by using the basic injection pulse signal Q/N and also some other engine parameters or the like in this step 102. In addition to this step 102, a step 100 is provided to detemine whether a predetermined period of time $\tau$ has elapsed or not. This predetemined period of time $\tau$ is selected to be longer than a time length required for executing one cycle of the program routine. Namely, in the case that subroutines or interrupt service routines are provided in the step 102, the predetermined time $\tau$ is selected by taking account a possible maximum time length for one cycle. If the determination at step 100 is NO, namely, when the predetermined period of time $\tau$ has not yet elapsed, the step 102 is exeucted. On the other hand if the detemination is YES, a step 104 is executed in which the level of an output signal at an output port of the microcomputer 12 is inverted. Therefore, the signal level at this output port is periodically inverted as shown in FIG. 5B to provide a pulse signal as long as the microcomputer 12 normally operates. If some troubles occur within the microcomputer 12, periodic execution of the routine is interrupted, and therefore, the output signal level at the output port is continuously fixed to either high or low level. This output signal from the above-mentioned output port is referred to as a monitoring signal hereafter, and is watched by the switching control signal generator 14 for fail-safe operation.

Figure 6:
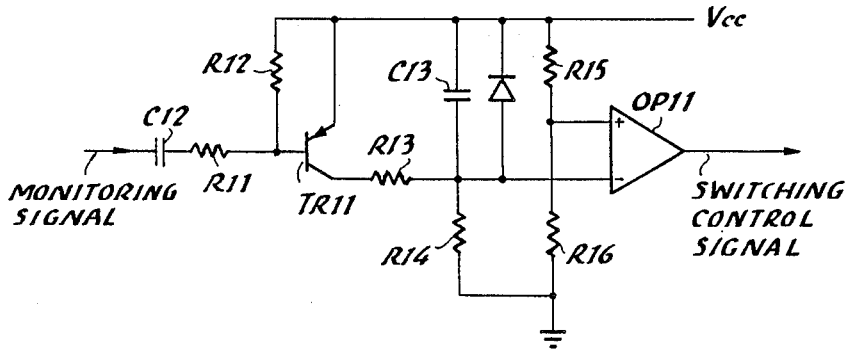
FIG. 6 is a circuit diagram of the switching signal generator of FIG. 2.

Reference is now made to FIG. 6 showing a circuit diagram of the switching control signal generator 14 of FIG. 2. The switching control signal generator 14 is responsive to the above-mentioned monitoring signal from the microcomputer 12. Assuming that the monitoring signal of FIG. 5B indicative of the normal state of the microcomputer 12 is fed to an input terminal of the switching control signal generator, each pulse of the monitoring signal is differentiated by a differentiator comprising a capacitor C12, and two resistors R11 and R12. A differentiated pulse is applied to a base of a transistor TR11 to render the same conductive. As a result, a capacitor C13 connected between a positive power source line Vcc and ground via a resistor R14 is discharged via the transistor TR11 and a resistor R13. The capacitor C13 is periodically discharged in response to the continuous pulses of the monitoring signal thereby keeping a voltage at an inverting input (−) of an operational amplifier OP11 lower than a reference voltage at a noniverting input (+) thereof, wherein the reference voltage is determined by a voltage divider comprising two resistors R15 and R16. As a result, the output signal level from the operational amplifier OP11 is kept low.

On the other hand, when the monitoring signal level is continuously fixed to either high or low level or when the pulse frequency thereof becomes lower than a predetermined value, sufficient discharging cannot be performed. Thus the voltage at the inverting input (−) of the operational amplifier OP11 lowers to be lower than the reference voltage. Therefore, the output signal level of the operational amplifier OP11 turns high. From the above it will be understood that the switching control signal generator 14 normally produces a low level output signal as long as the microcomputer 12 is in normal state, and produces a high level output signal immediately after the microcomputer 12 starts malfunctioning.

The switching control signal is used by the analog operating circuit 11 as described in the above, and also by the selecting circuit 16 to supply the transistor TR1 with either the basic injection pulse signal Q/N from the analog operating circuit 11 or the corrected injection pulse signal from the microcomputer 12. The selecting circuit 16 comprises an inverter INT1, first and second AND gates AND1 and AND2, and an OR gate OR1. In the case that the switching control signal is of low level, i.e. when the microcomputer 12 is in normal state, the second AND gate AND2 is enabled to transmit the corrected injection pulse signal from the microcomputer 12 to the transistor TR1 via the OR gate OR1, while the first AND gate AND1 is disabled. On the other hand, in receipt of a high level switching control signal the first AND gate AND1 is enabled, while the second AND gate AND2 is disabled to supply the transistor TR1 with the basic injection pulse signal Q/N from the analog operating circuit 11.

Although the switching control signal may be produced by using the monitoring signal from the microcomputer 12 as described in the above, since a given port signal level of a CPU is usually fixed to a given level whenever the CPU is reset, such a fixed level signal may be used as the switching control signal applied to the analog operating circuit 11 and to the selecting circuit 16. Namely, in the case such a CPU is employed, the switching control signal generator of FIGS. 2 and 6 may be unnecessary.

The above-described embodiment is just an example of the present invention, and therefore, it will be apparent for those skilled in the art that many modifications and variations may be made without departing from the spirit of the present invention.

What is claimed is:

1. Air/fuel ratio apparatus for an internal combustion engine, comprising:

(a) an airflow sensor for producing an output signal indicative of intake airflow of said engine;

(b) an engine rotation sensor for producing an output signal indicative of the rotational speed of said engine;

(c) an analog operating circuit responsive to said output signals from said airflow sensor and said engine rotation sensor for producing a basic injection pulse signal having a time width proportional to the intake airflow and inversely proportional to the rotational speed, said analog operating circuit including capacitor means which is charged with a charging current determined by said output signal from said engine rotation sensor and is discharged with a discharging current determined by said output signal from said airflow sensor for producing said basic injection pulse signal the width of which is determined in accordance with said charging and discharging currents so that said basic injection pulse signal is controlled on the basis of the output signals from said engine rotation sensor and said airflow sensor, said analog operating circuit further including a switching circuit means for allowing the amount of said charging current or said discharging current to be controlled so as to increase the width of said basic injection pulse signal, which is determined by said output signals from said engine rotation sensor and said airflow sensor when a switching control signal is inputted into said analog operating circuit and for generating a width-increased injection pulse signal in response to said switching control signal;

(d) means for generating at least one engine parameter signal indicative of at least one engine parameter;

(e) a programmed microcomputer responsive to said basic injection pulse signal and said at least one engine parameter signal for producing a corrected injection pulse signal by using said at least one engine parameter;

(f) means for monitoring the operational state of said microcomputer and producing said switching control signal when said microcomputer malfunctions and supplying said switching control signal to said switching circuit of said analog operating circuit;

(g) a selecting circuit, responsive to said analog operating circuit, said microcomputer and said monitoring means, for performing switching between said microcomputer and said analog operating circuit so that said corrected injection pulse signal is outputted in response to absence of said switching control signal and said width-increased injection pulse signal is outputted in response to presence of said switching control signal; and (h) means for supplying said engine with fuel by using an output signal from said selecting circuit.

2. Apparatus as claimed in claim 1, wherein the monitoring and producing means comprises:

(a) a differentiator responsive to a monitoring pulse signal produced by said microcomputer each time one cycle of the program routine has been completed;

(b) a capacitor arranged to be periodically discharged in response to an output signal from said differentiator, and (c) a voltage comparator for producing an output signal when the voltage across said capacitor has a predetermined relationship with respect to a reference voltage.

3. Air-fuel ratio control apparatus for an internal combustion engine comprising:

means for sensing intake airflow of said engine;

means for sensing rotational speed of said engine;

analog circuit means connected to said airflow sensing means and said speed sensing means for producing a basic injection pulse singal having a time width varying in accordance with the sensed intake airflow and the sensed rotational speed, said analog circuit means including capacitor means which is charged and discharged on the basis of the sensed intake airflow and the sensed rotational speed to determine the time width of said basic injection pulse signal, said analog circuit means being responsive to a switching control signal for controlling the charging or discharging of the capacitor mean so that the time width of said basic injection pulse signal is varied to be extended;

means for detecting engine operating parameters;

programmed digital computer means connected to said analog circuit means and programmed to produce a corrected injection pulse signal by extending the time width of the basic injection pulse signal in accordance with said engine operating parameters, said digital computer means being further programmed to produce a train of pulse signals when operating properly;

means for discriminating operational state of said digital computer means in response to the presence and absence of said train of pulse signals of said digital computer means and generating said switching control signal when the operational state of said digital computer means is discriminated as being malfunctioning;

selecting circuit means connected to said analog circuit means and said digital computer means further to said discriminating means for receiving said switching control signal and for selecting the time width-extended injection pulse signal from said analog circuit means in response to the presence of said switching control signal and selecting said corrected injection pulse signal from said digital computer means in response to the absence of said switching control signal; and fuel injector means connected to said selecting circuit means for injecting fuel into said engine in response to the selection.

* * * * *